United States Patent [19]

Nakahara

[11] Patent Number: 5,032,806

[45] Date of Patent: Jul. 16, 1991

[54] LOADED LINE PHASE SHIFTER

[75] Inventor: Kazuhiko Nakahara, Itami, Japan

[73] Assignee: Mitsubishi Denki Kabushiki Kaisha, Japan

[21] Appl. No.: 496,912

[22] Filed: Mar. 21, 1990

[30] Foreign Application Priority Data

Aug. 9, 1989 [JP] Japan ..... 1-206509

[51] Int. Cl.[5] ..... H01P 1/185

[52] U.S. Cl. ..... 333/161; 333/164

[58] Field of Search ..... 333/156, 161, 164, 246, 333/140

[56] References Cited

U.S. PATENT DOCUMENTS 4,458,219 7/1984 Vorhaus ..... 333/161 X

FOREIGN PATENT DOCUMENTS 0049002 3/1984 Japan ..... 333/161
59-51602 6/1984 Japan .
0072302 4/1985 Japan ..... 333/164
0276902 11/1988 Japan ..... 333/164

OTHER PUBLICATIONS

Naster et al., "Affordable MMIC Designs for Phased Arrays", Microwave Journal, Mar. 1987, pp. 141-147.

*Primary Examiner*—Eugene R. LaRoche
*Assistant Examiner*—Seung Ham
*Attorney, Agent, or Firm*—Leydig, Voit & Mayer

[57] ABSTRACT

A loaded line phase shifter using striplines diposed on a semiconductor substrate includes a main stripline having an electrical length of one-half wavelength, loaded striplines connected to respective ends of the main stripline, a field effect transistor having its source electrode and its drain electrode connected to the respective load lines, a bias circuit connected to the gate electrode of the field effect transistor for controlling the bias voltage applied to the gate electrode, and a resonant stripline connected between the source electrode and the drain electrode.

2 Claims, 6 Drawing Sheets

LOADED LINE PHASE SHIFTER

FIELD OF THE INVENTION

The present invention relates to loaded line phase shifters for controlling a phase shift amount by inserting susceptance loads in parallel with a main line to change the electrical length of the main line.

BACKGROUND OF THE INVENTION

FIG. 7 is a diagram showing an example of a conventional loaded line phase shifter formed on a semiconductor substrate, and FIG. 8 is a diagram showing an equivalent circuit of the loaded line phase shifter shown in FIG. 7. In FIG. 7, reference numeral 1 denotes a semiconductor substrate formed of silicon, GaAs, or the like, and 2 denotes a grounding conductor formed on the bottom surface of the semiconductor substrate 1 by a metallization such as gold. Reference numeral 3 denotes a main line of the loaded line phase shifter, and reference numerals 18 denote corrected lines loaded to the main line 3 with a spacing of approximately one-quarter wavelength. Reference numerals 5*a* and 5*b* denote drain electrodes of field effect transistors (referred to as FETs hereinafter), 6*a* and 6*b* denote gate electrodes of the FETs, and reference numeral 19 denotes a common source electrode of the two FETs. The drain electrode 5*a*, the gate electrode 6*a*, and the source electrode 19 constitute an FET 8*a*, and the drain electrode 5*b*, the gate electrode 6*b*, and the source electrode 19 constitute an FET 8*b*. Reference numerals 9*a* and 9*b* denote high impedance lines approximately one-quarter wavelength long, 10*a* and 10*b* denote low impedance lines approximately one-quarter wavelength long, and 11*a* and 11*b* denote bias pads for receiving external driving bias voltages. The high impedance line 9*a*, the low impedance line 10*a*, and the bias pad 11*a* constitute a distributed constant bias circuit 12*a*, and the high impedance line 9*b*, the low impedance line 10*b*, and the bias pad 11*b* constitute a distributed constant bias circuit 12*b*. Reference numeral 13 denotes a high impedance line approximately one-quarter wavelength long, 14 denotes a low impedance line approximately one-quarter wavelength long, and 15 denotes a grounding pad. The high impedance line 13, the low impedance line 14, and the grounding pad 15 constitute a grounding bias circuit 16 which is connected to the main line 3. In addition, reference numeral 20 denotes a gold wire for grounding the source electrode 19, 24 denotes an input terminal, and 25 denotes an output terminal.

In the loaded line phase shifter having the above described structure, the same driving bias voltage must always be applied to the two FETs 8*a* and 8*b*. This driving bias voltage is switched to forward bias (zero volt) or reverse bias (minus several volts) to change the impedances of the FETs 8*a* and, 8*b* and therefore, to change the susceptance of the loaded lines 18 viewed from the main line 3. The loaded line phase shifter exercises control such that the difference in transmission phases becomes a desired value. The grounding conductor 2 is grounded by soldering into a chassis or the like. The driving bias voltage is applied to the gate electrodes 6*a* and 6*b* from the distributed constant bias circuits 12*a* and 12*b*, respectively. In order to normally operate the FETs 8*a* and 8*b*, the common source electrode 19 is grounded by the gold wire 20 or the like and the drain electrodes 5*a* and 5*b* are grounded by grounding the grounding pad 15 using a gold wire or the like, so that the common electrode 19 and the drain electrodes 5*a* and 5*b* are set at the same voltage level as the grounding conductor 2.

When the driving bias voltage is a forward bias, the FETs 8*a* and 8*b* are on, so that the FET is brought to a resistance of several ohms. Accordingly, in this case, the impedance of the FET viewed from nodes of the main line 3 and the loading lines 18 becomes inductive. On the other hand, when the driving bias voltage is the reverse bias, the FETs 8*a* and 8*b* are off, so that the FET appears as a capacitance between the source electrode with the drain electrode and a parallel-connected resistance of several kilo-ohms. Accordingly, in this case, the impedance of the FET portion viewed from the nodes of the main line 3 and the loading lines 18 becomes capacitive.

As described in the foregoing, the bias voltage applied to the gate electrodes 6*a* and 6*b* is changed to make the FETs 8*a* and 8*b* inductive stubs or capacitive stubs, thereby changing the phase of a wave propagating along the main line 3.

In the conventional loaded line phase shifter formed on a semiconductor substrate, however, the susceptance values of the two loaded lines 18 are respectively changed using the different FETs 8*a* and 8*b* as described above. Accordingly, variations in characteristics between the two FETs 8*a* and 8*b* introduce the problem that phase characteristics and insertion loss characteristics or the like of the phase shifter are degraded so that the desired phase shift characteristics cannot be obtained.

FIG. 9 shows an example of a loaded line phase shifter constructed to make variations in characteristics between the FETs as small as possible in consideration of the above described problem. More specifically, FIG. 9 is a circuit diagram showing a loaded line phase shifter in another conventional example which is disclosed in Japanese published Patent Application 59-51602, and FIG. 10 is a diagram showing an equivalent circuit of the loaded line phase shifter shown in FIG. 9. In FIGS. 9 and 10, the same reference numerals as those in FIGS. 7 and 8 refer to the same elements. Reference numeral 21 denotes a penetrating conductor 21 for grounding a source electrode 19, 22 denotes a capacitor connected to both gate electrodes 6*a* and 6*b*, and 23 denotes a bias circuit having its end connected to the capacitor 22. This loaded line phase shifter is arranged such that the source electrode 19 is common to two FETs 8*a* and 8*b* and connected to respective end terminals of loaded lines 18. The loaded lines 18 are connected to the main line 3 with a spacing of one-quarter wavelength. This arrangement makes the FETs 8*a* and 8*b* as similar to each other as possible. In addition the common source electrode 19 is connected to a grounding conductor 2 by the penetrating conductor 21 to decrease variations in characteristics between the FETs. In addition, the capacitor 22 is connected to both the gate electrodes 6*a* and 6*b* and the bias circuit 23 is connected to one end of the capacitor 22 to apply a bias voltage to the gate electrodes 6*a* and 6*b*.

In the loaded line phase shifter having this structure, the bias voltage applied to the gate electrodes 6*a* and 6*b* through the bias circuit 23 is changed to change the susceptance of the connected lines 18 loaded to the main line 3 with spacing of one-quarter wavelength, thereby changing the phase of a wave propagating along the main line 3, as in the above described loaded line phase shifter in the first conventional example.

In the above described structure, the FETs 8*a* and 8*b* are disposed in close proximity to each other at one end of each of the loading lines 18. Accordingly, the loaded line phase shifter has the advantage that variations in characteristics between the FETs 8*a* and 8*b* can be prevented, as compared with the above described loaded line phase shifter in the first conventional example shown in FIG. 7. In addition, a single bias circuit is used for determining the bias voltage applied to the gate electrodes 6*a* and 6*b*. Accordingly, the loaded line phase shifter has the advantage that the bias circuit can be simplified.

In the structure of the loaded line phase shifter in the above described second conventional example, variations in characteristics between the FETs 8*a* and 8*b* can be decreased but cannot be completely eliminated. Furthermore, in the above described both first and second conventional examples, the source electrode 19 must be grounded. Consequently, various problems arise. More specifically, in the first conventional example, the source electrode 19 is grounded by the gold wire 20. Accordingly, variations in the inductive component of the gold wire 20 on the entire phase shifter are produced by non-uniformities in the length of the gold wire 20 so that the phase characteristics of the phase shifter are changed. These variations increase insertion loss and the voltage standing wave ratio (referred to as VSWR hereinafter) of the phase shifter. In addition, the source electrode 19 must be formed at an end of a substrate in order to minimize these problems in the performance of the phase shifter due to the inductance component of the gold wire 20, limiting pattern design.

Furthermore, in the second conventional example, the source electrode 19 is grounded using the penetrating conductor 21. Also in this case, the induction component of the penetrating conductor 21 cannot be ignored, thereby presenting the same problem as that in the first conventional example. In addition, although the degree of freedom in pattern design is increased, complicated manufacturing processes are required to form the penetrating conductor 21.

SUMMARY OF THE INVENTION

An object of the present invention is to provide a loaded line phase shifter solving the problems in of the performance of the phase shifter due to effects, such as non-uniformities in the FETs and a gold wire connection as well as removing the restrictions in pattern design due to a source electrode.

Other objects and advantages of the present invention will become apparent from the detailed description given hereinafter. It should be understood, however, that the detailed description and specific embodiment are given by way of illustration only, since various changes and modifications within the spirit and scope of the invention will become apparent to those skilled in the art from this detailed description.

The present invention is directed to a loaded line phase shifter having a main line and loaded lines, each comprising a stripe-line disposed on a semiconductor substrate and an FET disposed on the semiconductor substrate, the electrical length of the main line being one-half wavelength, with loaded lines connected to both ends of the main line and a source electrode and a drain electrode of the FET respectively connected to positions spaced from the nodes of the main line and the loaded lines by the same electrical length. A bias circuit comprising a stripline for controlling the bias voltage is connected to a gate electrode of the FET, and a resonant line comprising a stripline is connected between the source electrode and the drain electrode.

The loaded line phase shifter according to the present invention is operated by controlling the gate voltage of the FET. Accordingly, susceptance of the two loaded lines can be controlled by a single FET and the source electrode need not be grounded. Consequently, degradation of the performance of the phase shifter, due to effects such as non-uniformities in the characteristics of a pair of FETs connected to the loaded lines, and grounding of the source electrode with a gold wire a in the conventional examples is prevented. In addition, the degree of freedom in pattern design is improved.

BRIEF DESCRIPTION OF THE DRAWINGS

FIG. 3 is a diagram showing an equivalent circuit of a loaded line phase shifter according to an embodiment of the present invention when an FET for controlling susceptance values of loaded lines is on;

DETAILED DESCRIPTION OF THE PREFERRED EMBODIMENTS

An embodiment of the present invention will be described in detail with reference to the drawings.

Figure 1:
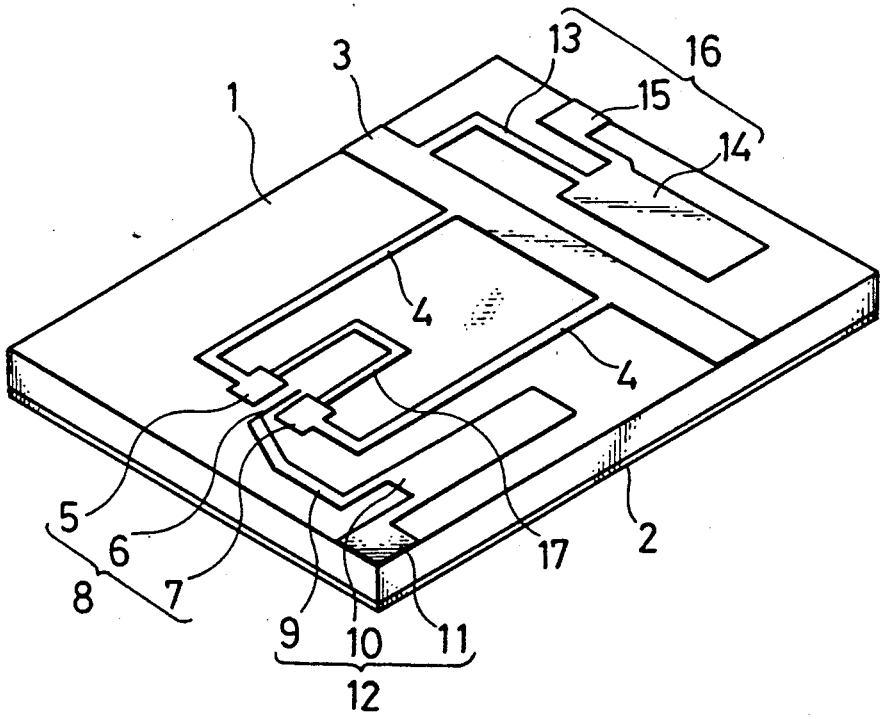
FIG. 1 is a perspective view of a loaded line phase shifter according to an embodiment of the present invention.

FIG. 1 is a perspective view showing a loaded line phase shifter according to an embodiment of the present invention. In FIG. 1, the same reference numerals as those in the above described conventional loaded line phase shifter refer to the same elements. Loaded lines 4 are connected to a main line 3 with spacing of an electrical length of a one-half wavelength. A reference numeral 17 denotes a resonant line comprising a stripline. FIG. 1 illustrates only a substrate portion of the loaded line phase shifter. When the loaded line phase shifter is actually used as a phase shifter, a grounding conductor 2 is grounded by soldering the semiconductor substrate 1 onto a chassis or the like and a grounding pad 15 is grounded by a gold wire or the like.

In the loaded line phase shifter according to the present invention, lengths of the two loaded lines 4 are set depending on a desired phase shift amount and connected to the main line 3 with a spacing of a one-half wavelength. The end terminals of the two loaded lines 4 are respectively connected to a source electrode 7 and a drain electrode 5 of an FET 8. A resonant stripline 17 is connected between the source electrode 7 and the drain electrode 5 of the FET 8, and a distributed constant bias circuit 12 comprising a high impedance line 9, a low impedance line 10, and a bias pad 11 is connected to a gate electrode 6 of the FET 8, thereby controlling a driving bias voltage applied to the gate electrode 6. In addition, a grounding bias pad 16 comprising a high impedance line 13, a low impedance line 14, and a grounding pad 15 is connected to the main line 3.

Figure 2:
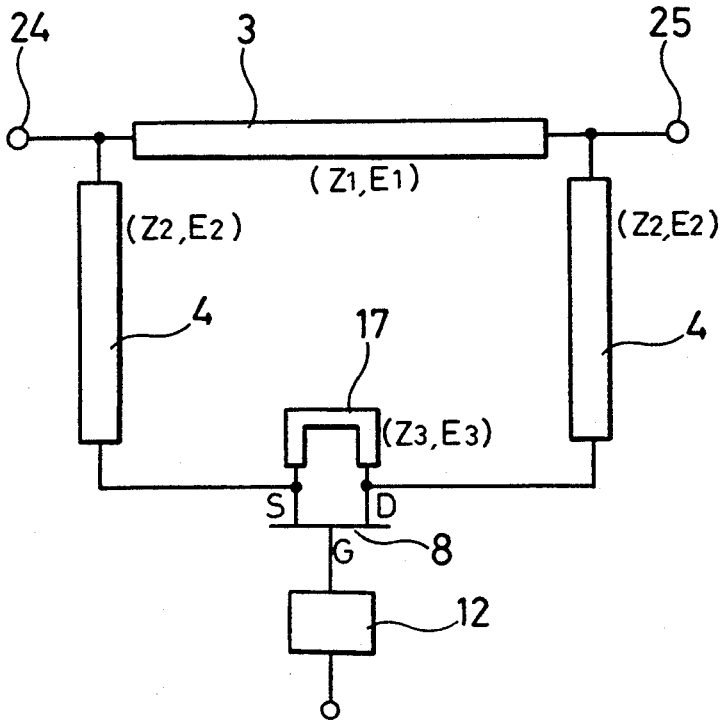
FIG. 2 is a diagram showing an equivalent circuit of the loaded line phase shifter shown in FIG. 1.

FIG. 2 is a diagram showing an equivalent circuit of the loaded line phase shifter shown in FIG. 1. In FIG. 2, reference numeral 24 denotes an input terminal, and reference numeral 25 denotes an output terminal. The driving bias voltage applied to the gate electrode 6 of the FET 8 is changed to a forward bias (zero volt) or a reverse bias (minus several volts) by the distributed constant bias circuit 12 to change the impedance of the FET 8 and, therefore, to change the susceptance of the loaded lines 4 viewed from the main line 3. The loaded line phase shifter exercises control such that the difference in transmission phases becomes a desired value, thereby changing the phase of a wave propagating along the main line 3 is operated as a phase shifter.

First, the case in which the gate driving bias voltage is a forward bias is described.

Figure 3:
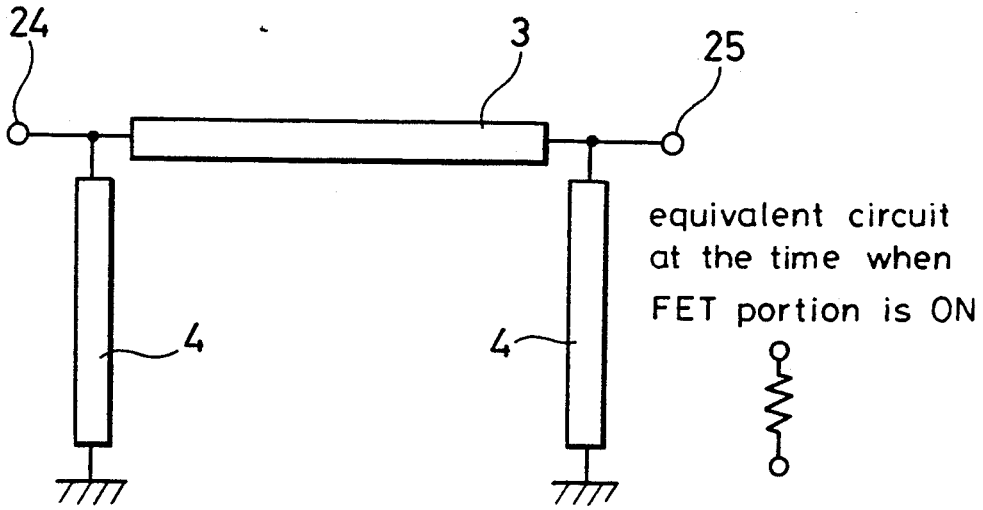

At the time of forward bias, the FET 8 is switched on so that an FET 8 can be considered to be a low resistance. Furthermore, on this occasion, the electrical length of the main line 3 is one-half wavelength. Accordingly, it follows that the phases of high frequencies inputted to the FET 8 from the two loaded lines 4 are reversed by 180°. Consequently, high frequency components of both the loaded lines 4 cancel each other in the FET 8 so that the loaded lines 4 can be considered to be grounded. Accordingly, grounding of the loaded lines 4 to a grounding conductor is not required In this case, the impedances viewed from nodes of the loaded lines 4 and the main line 3 toward an end of the FET 8 become inductive. Consequently, the equivalent circuit changes as if both the loaded lines 4 are grounded as shown in FIG. 3.

The case in which the gate driving bias voltage is a reverse bias is now describable.

Figure 4:
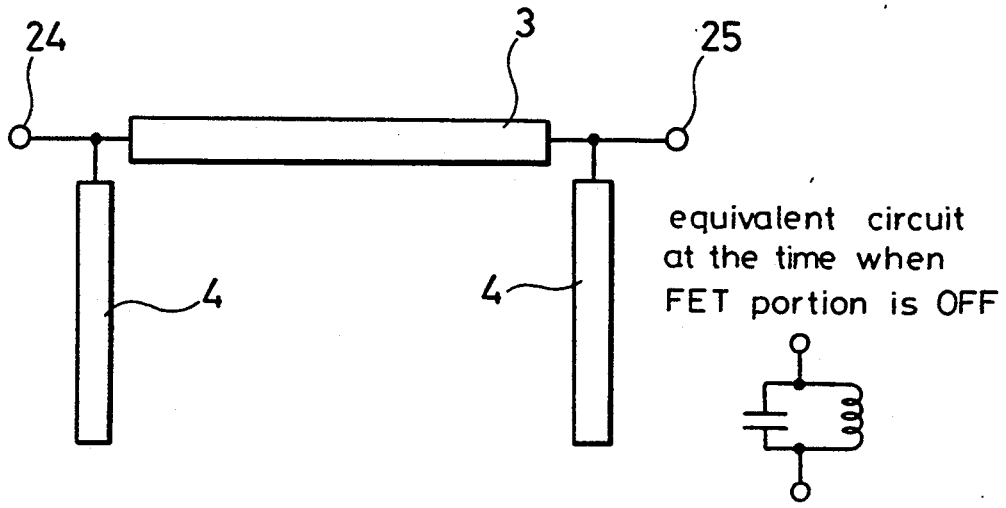
FIG. 4 is a diagram showing an equivalent circuit of the loaded line phase shifter according to an embodiment of the present invention when an FET for controlling susceptance values of the loaded lines is off.

At the time of the reverse bias, the FET 8 is off. In the FET 8, the capacitance between the source electrode 7 and the drain electrode 5 and the resonant line 17 form a resonant circuit so that the impedance of the resonant circuit at a frequency of interest becomes very high and theoretically infinity. Accordingly, the impedances viewed from the nodes of the loading lines 4 and the main line 3 toward the end of the FET 8 becomes capacitive, and the terminals of the loaded lines 4 can be considered to be opened. Consequently, the equivalent circuit changes to that illustrated in FIG. 4.

An example of circuit constants of the main line 3, the resonant line 17, and the loading line 4 in embodiments of loaded line phase shifters according to the present invention for a 45°, a 22.5° bit phase shifter and a 11.25° phase shifter are described in Table 1.

TABLE 1

| | main line | | resonant line | | loaded line | |
|---|---|---|---|---|---|---|
| | $Z_1$ | $E_1$ | $Z_3$ | $E_3$ | $Z_2$ | $E_2$ |
| 45° phase shifter | 50Ω | 180° | 94Ω | 23° | 100Ω | 185° |

TABLE 1-continued

| | main line | | resonant line | | loaded line | |
|---|---|---|---|---|---|---|
| | $Z_1$ | $E_1$ | $Z_3$ | $E_3$ | $Z_2$ | $E_2$ |
| 22.5° phase shifter | 50Ω | 180° | 183Ω | 47° | 47Ω | 61° |
| 11.25° phase shifter | 50Ω | 180° | 139Ω | 42° | 92Ω | 241° |

where Z: characteristic impedance

E: electrical length

An example of the results of a simulation for loaded line phase shifters having such circuit constants and using an FET 8 having a source-drain resistance of 3.5 Ω when on and a capacitance value of 2.6 pF and a source-drain resistance of 3 kΩ when off are shown in Table 2. The range of frequency used is 11.7 GHz to 12.3 GHz.

TABLE 2

| | VSWR | | insertion | phase shift |
|---|---|---|---|---|
| | input side | output side | loss (dB) | amount (°) |
| 45° phase shifter | 2.24~2.97 | 2.24~2.97 | 1.39~1.67 | 45 +1.3 −1.1 |
| 22.5° phase shifter | 1.47~1.63 | 1.47~1.63 | 0.48~0.89 | 22.5 +1.5 −1.9 |
| 11.25° phase shifer | 1.39~1.69 | 1.39~1.69 | 0.21~0.39 | 11.25 +1.08 −1.1 |

Figure 5:
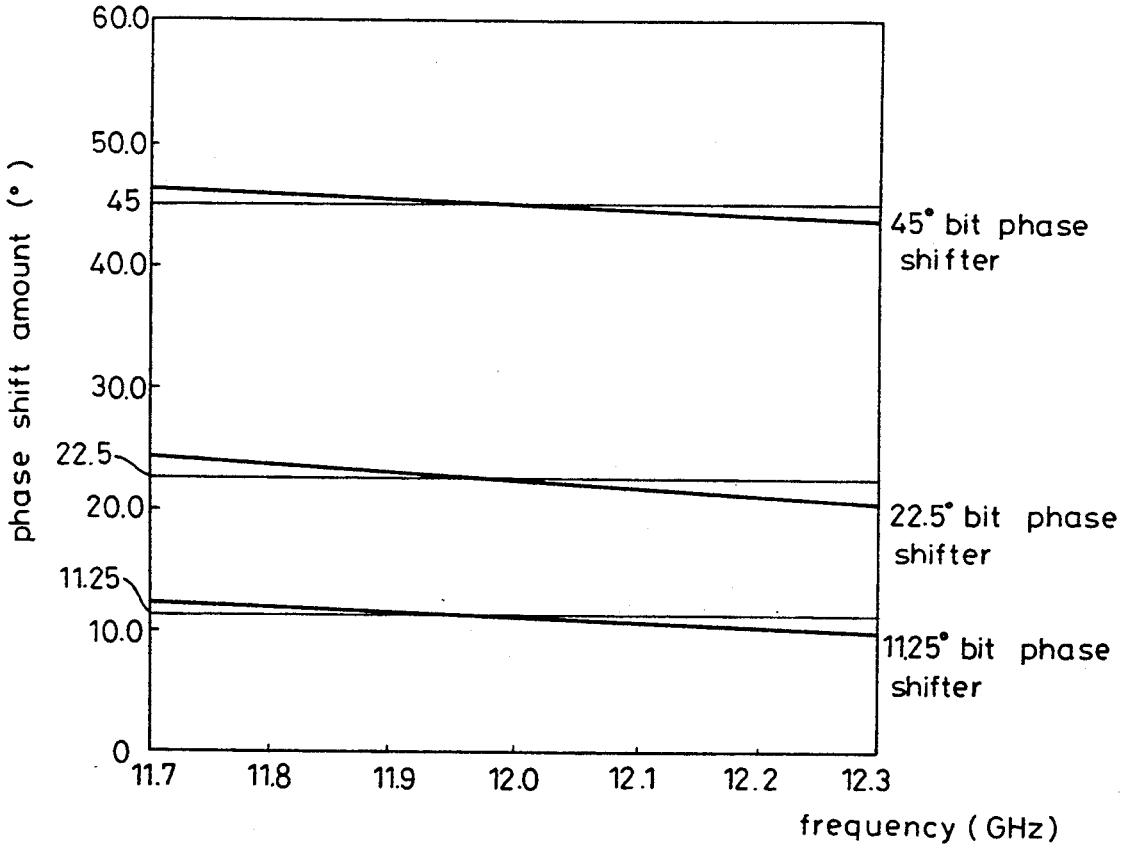
FIG. 5 is a diagram showing an example of the results of simulation of the loaded line phase shifter according to an embodiment of the present invention.

Additionally, FIG. 5 graphically shows the phase shift amount in the above described frequency range for each of the phase shifters. As can be seen from the above described results, the present invention is particularly effective for a small phase shift amount. In this case, a large decrease in VSWR and insertion loss can be achieved.

As described in the in, the loaded line phase shifter according to the present embodiment, a single FET is used for controlling susceptance of the loaded lines 4 and grounding of the FET by a gold wire or the like is not required. Accordingly, the degradation of phase characteristics, due to effects such as non-uniformities between a pair of FETs for controlling the susceptance of the loaded lines and in the gold wire used for grounding the FETs in the conventional examples is prevented. Consequently, a reproducible, high-precision phase shifter having desired phase characteristics is obtained. In addition, the FET need not be grounded, so that the degree of freedom in pattern design and manufacturing processes is increased.

Figure 6:
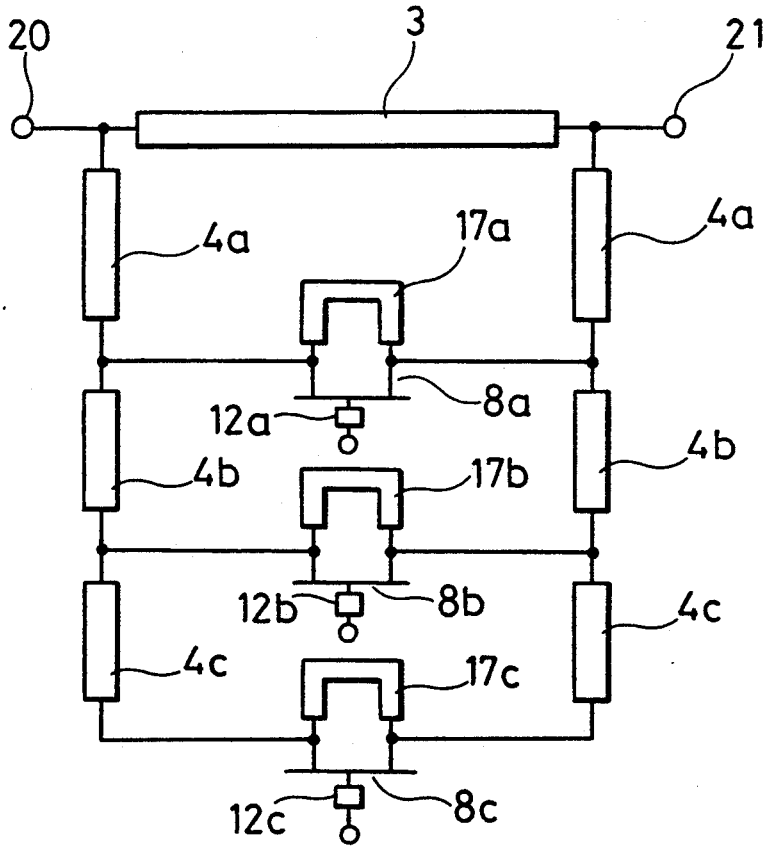
FIG. 6 is a diagram of a multiple-bit loaded line phase shifter according to another embodiment of the invention.
Figure 7:
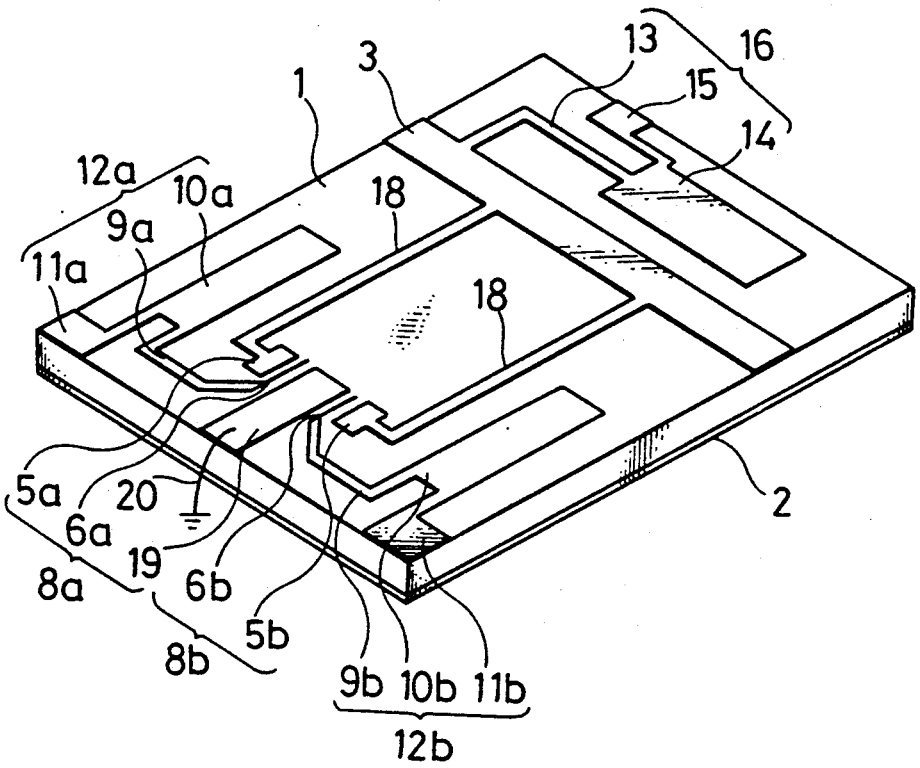
FIG. 7. (PRIOR ART)
FIG. 7 is a perspective view showing an example of a conventional loaded line phase shifter.
Figure 8:
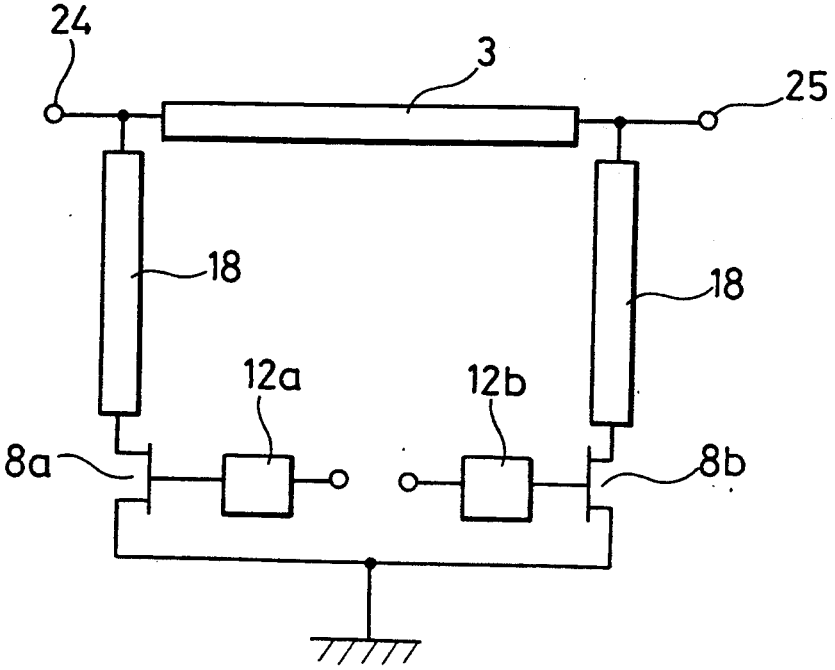
FIG. 8. (PRIOR ART)
FIG. 8 is a diagram showing an equivalent circuit of the loaded line phase shifter shown in FIG. 7.
Figure 9:
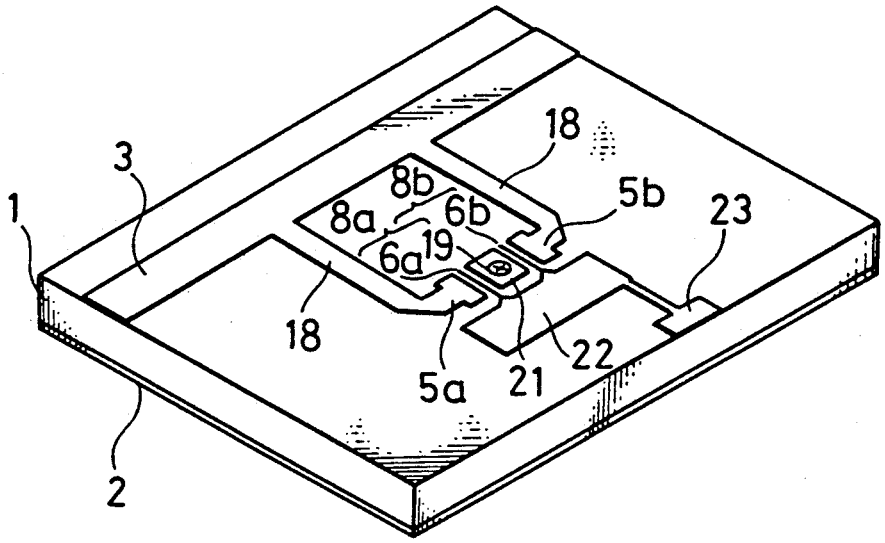
FIG. 9. (PRIOR ART)
FIG. 9 is a diagram showing a loaded line phase shifter in another conventional example.
Figure 10:
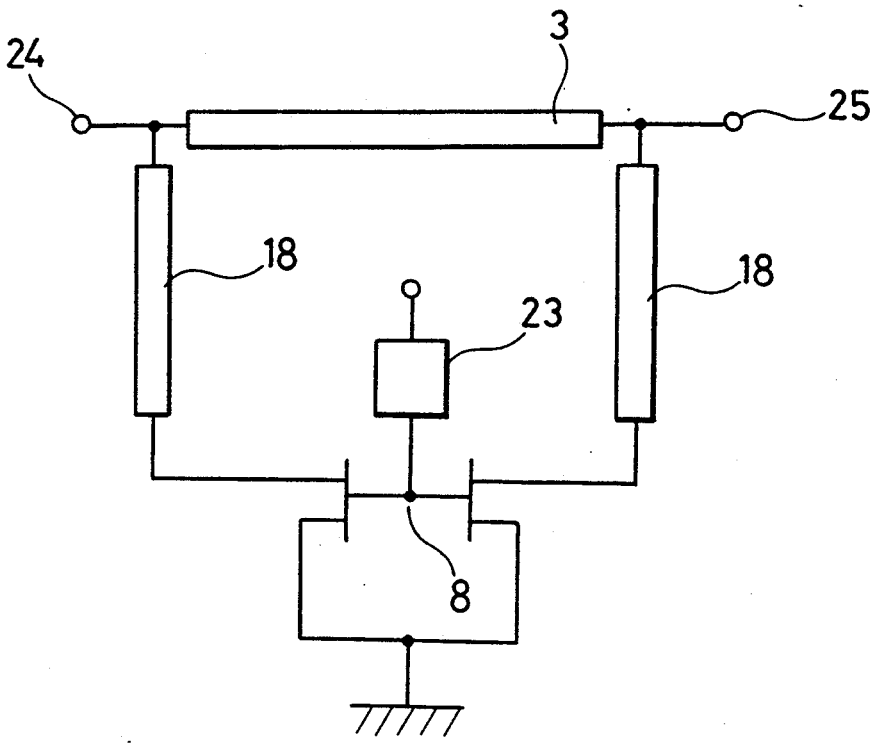
FIG. 10. (PRIOR ART)
FIG. 10 is a diagram showing an equivalent circuit of the loaded line phase shifter shown in FIG. 9.

Additionally, FIG. 6 shows an example in which several FETs are added &o intermediate points of the loaded lines in the loaded line phase shifter having the structure according to the above described embodiments, to construct a multiple-shift loaded line phase shifter as another embodiment of the present invention.

In FIG. 6, reference numerals 4*a* to 4*c* denote loaded lines, 8*a* to 8*c* denote FETs respectively connected to ends of the loaded lines 4*a*, 4*b*, and 4*c*, 17*a* to 17*c* denote resonant lines respectively connected between source electrodes and drain electrodes of the FETs 8*a* to 8*c*, and 12*a* to 12*c* denote distributed constant bias circuits for respectively controlling the bias voltages applied to gate electrodes of the FETs 8*a* to 8*c*.

In the loaded line phase shifter having such a structure, only the loaded lines 4*a* are used when only the FET 8*a* is on, the loaded lines 4*a* and 4*b* are used when the FETs 8*a* and 8*b* are on and the FET 8*c* is off, and all the loaded lines 4*a* and 4*c* are used when all the FETs 8*a* to 8*c* are on. Accordingly, the length of the loaded line is varied by placing selected ones of the FETs 8*a* to 8*c* in the on state or the off state. The present embodiment has the advantage that many phase shift amounts can be obtained using a single loaded line phase shifter, in addition to the effect of the above described embodiment.

As described in the foregoing, according to the present invention, the loaded line phase shifter has a main line of electrical length of one-half wavelength, loaded lines connected to both ends of the main line, a source electrode and a drain electrode of an FET respectively connected to positions spaced apart from the nodes of the loaded lines and the main line by the same electrical length, a bias circuit comprising a strip line for controlling the bias voltage applied to a gate electrode of the FET, and a resonant stripline connected between the source electrode and drain electrode. Accordingly, a single FET can be used for controlling grounding of the source electrode, so that the present invention achieves a high-precision loaded line phase shifter unaffected by non-uniformities in the characteristics a pair of FETs, lengths of gold wire, or the like. In addition, no grounding of the FET is required so that the present invention increases the degree of freedom in pattern design and manufacturing processes.

What is claimed is:

1. A loaded line stripline phase shifter disposed on a semiconductor substrate comprising:

a main stripline having first and second ends and an electrical length between the first and second ends of one-half wavelength;

first and second loaded striplines, the first and second striplines being connected to the first and second ends of said main stripline, respectively;

a field effect transistor including a source electrode, a drain electrode, and a gate electrode, said source and drain electrodes being respectively connected to said first and second loaded striplines at locations spaced from said main stripline by the same electrical length;

a bias circuit comprising a stripline connected to said gate electrode of said field effect transistor for controlling a bias voltage applied to said gate electrode; and a resonant stripline connected between said source electrode and said drain electrode.

2. A load line stripline phase shifter disposed on a semiconductor substrate comprising:

a main stripline having first and second ends and an electrical length between the first and second ends of one-half wavelength;

a plurality of pairs of loaded striplines, each pair of loaded striplines having a different electrical length and including a first and a second loaded stripline of the same electrical length, the first and second loaded striplines of each pair of loaded striplines being connected to the first and second ends of said main stripline, respectively;

a plurality of field effect transistors each having a source electrode, a drain electrode, and a gate electrode, each field effect transistor having its source and drain electrodes connected to the first and second loaded striplines of a corresponding pair of loaded striplines;

a plurality of bias circuits for respectively controlling a bias voltage applied to the gate electrode of a corresponding field effect transistor; and a plurality of resonant striplines, each resonant stripline being connected between the source and drain electrodes of a corresponding field effect transistor.

* * * * *